United States Patent [19]

Rapids

[11] 4,067,781

[45] Jan. 10, 1978

[54] METHOD FOR ELECTROPLATING

[76] Inventor: Felix R. Rapids, 5050 SE. End Ave., Chicago, Ill. 60615

[21] Appl. No.: 758,197

[22] Filed: Jan. 10, 1977

[51] Int. Cl.[2] ..... C25D 5/06; C25D 5/34; C25D 17/14

[52] U.S. Cl. ..... 204/15; 204/224 R

[58] Field of Search ..... 204/15, 224 R, 50 R, 204/53, 54 R

[56] References Cited

U.S. PATENT DOCUMENTS

| | | | |
|---|---|---|---|
| 2,318,592 | 5/1943 | Cupery | 204/53 |
| 2,489,523 | 11/1949 | Clifton | 204/54 R |
| 3,746,627 | 7/1973 | Rapids | 204/224 R |
| 3,755,089 | 8/1973 | Rapids | 204/224 R |
| 3,769,182 | 10/1973 | Hsu | 204/53 |

*Primary Examiner*—T. M. Tufariello

*Attorney, Agent, or Firm*—Hill, Gross, Simpson, Van Santen, Steadman, Chiara & Simpson

[57] ABSTRACT

An improved method and composition for plating a workpiece with tin, cadmium, lead, or indium which involves first applying an aqueous electrolyte to the substrate with a rubbing action and without electroplating voltage being applied and then applying the electroplating voltage to an anode composed of one of the aforementioned metals, utilizing the same aqueous electrolyte to plate metal from the anode onto the substrate. The aqueous electrolyte contains dissolved free sulfamic acid in concentrations up to saturation, and the electrolyte is substantially devoid of ions of a plateable metal. The electrolyte preferably includes a small amount of a surface active wetting agent.

4 Claims, 3 Drawing Figures

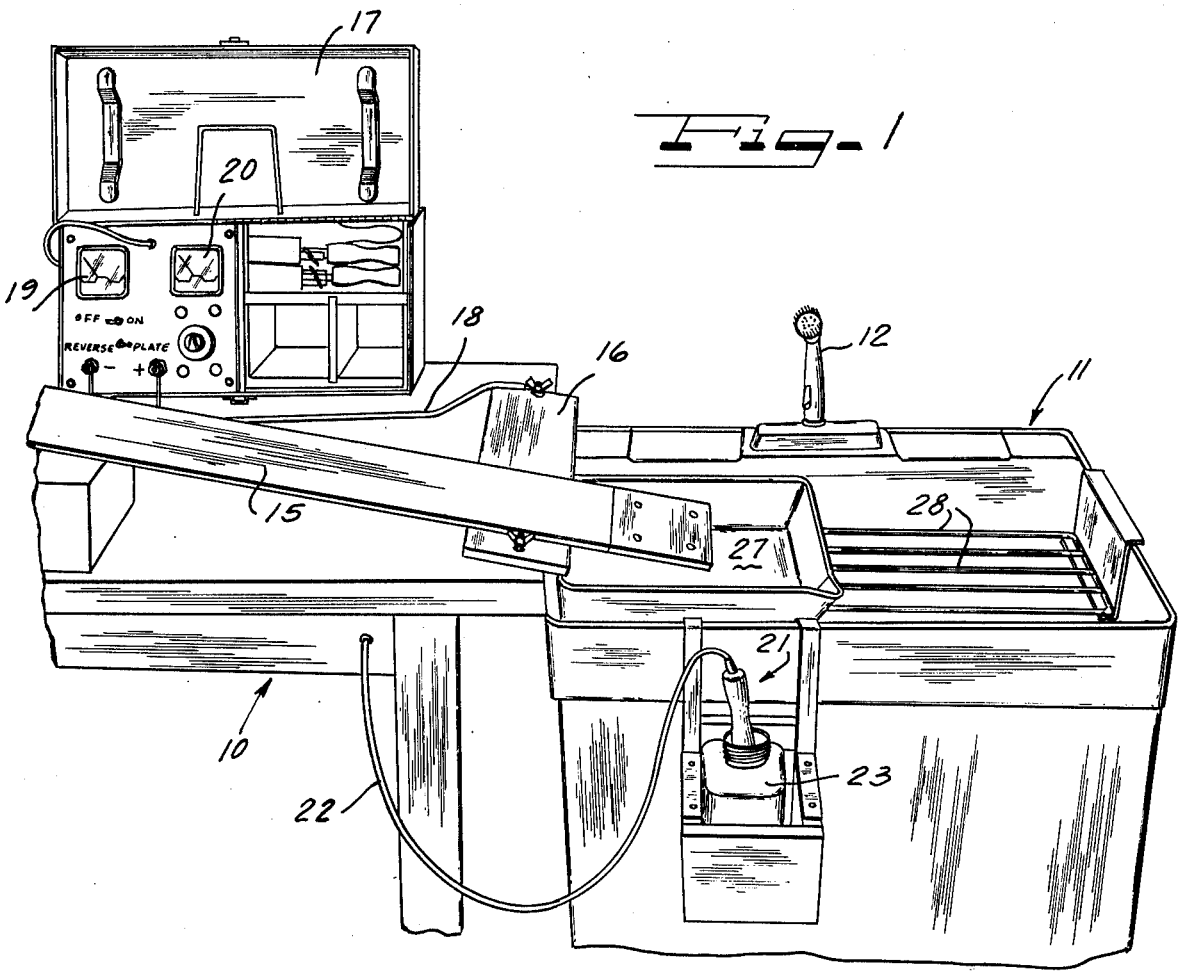
Fig. 1
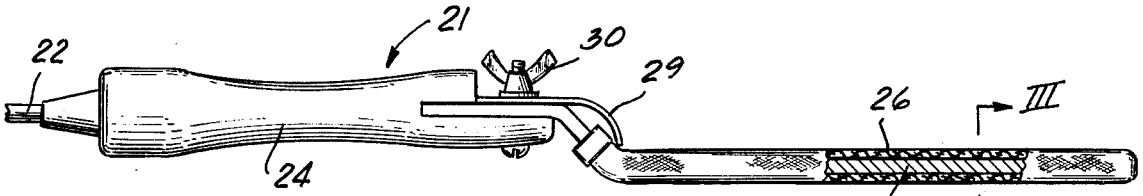
Fig. 2
Fig. 3
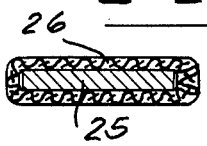

METHOD FOR ELECTROPLATING

BACKGROUND OF THE INVENTION

1. Field of the Invention

This invention is in the field of portable electroplating utilizing an anode composed of tin, cadmium, lead, or indium encased with a fluid absorptive sleeve which has been immersed in an aqueous electrolyte containing free sulfamic acid. An electroplating current is applied between the anode and the workpiece to thereby deposit a plating at selected areas of the workpiece.

2. Description of the Prior Art

In my U.S. Pat. No. 3,525,681 there is described an electrolytic device for applying an electric current through an electrolyte to a metal surface, the device including absorbent sleeves which hold liquid electrolyte against the anode for plating purposes.

In my later patent, U.S. Pat. No. 3,746,627, there is described a method of metal electroplating for depositing a localized plating on an electrically conductive portable member. The workpiece to be plated is removably positioned on an electrically conductive current carrying cathode bar. The contact area to be plated is rubbed with a plating electrolyte-carrier to wet the area with the electrolyte and build up a plated layer.

The present invention may utilize the type of method and apparatus described in aforementioned U.S. Pat. No. 3,746,627 but makes use of an improved electrolyte. Heretofore, electrolytes for portable plating frequently used corrosive materials such as sulfuric acid, sodium or potassium hydroxide, sodium or potassium cyanides, and salts of plateable metals. The use of such chemicals made it necessary to provide safeguards for operating personnel to prevent contact with the chemicals. It was also necessary to use specialized, expensive containers for handling and shipping the chemicals which necessarily increased the cost. Since many of these materials also gave off noxious fumes, pollution control of the atmosphere was a problem.

SUMMARY OF THE INVENTION

The present invention provides an improved electrolyte for plating tin, cadmium, lead or indium by means of a hand-held applicator with an anode of the desired metal encased in an absorbent sleeve. When the sleeve is saturated with the electrolyte solution and rubbed on the work with the application of a plating current, the metal content from the anode is supplied only during the actual plating operation.

The method of the present invention can be used for the repair of maintenance of military and other aircraft, for building up commercial platings at points of greatest wear, for plating specific areas of moving parts, to prevent galling or seizing, for plating contact areas of copper bus bars to prevent power losses and ensure electrical service, and for numerous other purposes.

The improved electrolyte of the present invention is an aqueous solution of free sulfamic acid containing amounts of from ¼ ounce sulfamic acid per 16 fluid ounces of electrolyte (7.09 grams/473.2 ml) up to the saturation level of sulfamic acid in water. The electrolyte solution also preferably contains a wetting agent which may be of the anionic type or the non-ionic type, the latter being preferred. The wetting agent is added in small, non-foaming amounts typically on the order of 3 to 5 drops per 16 liquid ounces of water (0.18 to 0.30 ml).

The electrolyte of the present invention meets safety requirements for workers and contains no corrosive chemicals. It thereby meets OSHA and other requirements and permits shipment without limitation by air, land or sea. Since no noxious fumes are given off, no elaborate pollution control equipment is necessary.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 illustrates an apparatus suitable for carrying out the method of the present invention;

FIG. 2 is a view of the applicator element alone; and

FIG. 3 is a cross-sectional view taken along the line III—III of FIG. 2.

DESCRIPTION OF THE PREFERRED EMBODIMENTS

The method of the present invention involves applying an aqueous sulfamic acid electrolyte to a plating substrate with a rubbing action and without electroplating voltage being applied, followed by applying an electroplating voltage to an anode composed of tin, cadmium, lead or indium and utilizing the same aqueous electrolyte to plate metal from the anode onto the substrate. The plating is also accomplished with a rubbing action. Both the initial contacting of the workpiece with the electrolyte and the final electroplating step can be conveniently accomplished by use of a portable anode encased in an absorbent sleeve composed of an inert material such as polyacrylonitrile which is uniformly porous.

The improved electrolyte of the present invention consists of an aqueous solution containing for each 16 fluid ounces (473 ml) of water, from ¼ ounce (7.09 g) to enough granular sulfamic acid to reach saturation. Sulfamic acid is moderately soluble in water. About 14.7 grams dissolve in 100 grams of water at 0° C and 47.1 grams at 80° C.

The electrolyte of the present invention also preferably includes an anionic or non-ionic surface active agent in amounts of from 0.18 to 0.30 ml per 16 fluid ounces of water. I prefer to use normally liquid, non-ionic surface active materials such as those known as "Triton NE" which consist of high molecular weight complex organic alcohols. Other suitable surface active agents include the "Tergitols" which are higher sodium alkyl sulfates and ethoxylated alkyl phenols such as "Surfonic N-60" which is an ethoxylated nonyl phenol. These materials should be used in small amounts so as not to cause foaming during plating.

The plating voltage will normally extend from about 2 volts to about 10 volts for purposes of safety. Even at such relatively low voltages, adequate plating thicknesses can be achieved in reasonably short periods of time. Plating voltages as low as 1 volt can be used to apply a thin coat, if the edge of the anode is used as the plating surface. Plating voltages of 10 volts or so can be used to obtain very high current densities on the order of up to 25 amperes per square inch which is the equivalent of up to 3600 amperes per square foot. Upon continued plating with the solution of the present invention, the anode of the applicator heats up, thereby further increasing the rate of deposition when applying extra heavy platings.

FIG. 1 illustrates an apparatus suitable for use in carrying out the method of the present invention. It includes a bench 10 and a sink 11 having a spray device 12 for supplying rinse water to the sink.

A workpiece 15 composed of cold rolled steel, or the like, is positioned on a cathode bar 16 which is connected to the negative side of a power supply 17 by means of a cable 18. The power supply 17 also includes the usual voltmeter 19 and an ammeter 20. The free end of the workpiece 15 is positioned over a tray 27 located in the sink 11 and movable on bars 28. The function of the tray 27 is to catch any drippings that might flow from the end of the workpiece before or during plating for re-use.

A plating electrolyte carrier generally indicated at reference numeral 21 is illustrated more completely in FIGS. 2 and 3 of the drawings. The carrier 21 is connected by means of a cable 22 to the positive side of the power supply 17. The electrolyte carrier 21 may be received in a jar 23 located below the level of the sink 11, the jar being partially filled with the improved electrolyte solution of the present invention.

As illustrated in FIG. 2, the plating electrolyte carrier includes a handle 24 and an offset rectangular portion 25 which is covered by a liquid absorptive sleeve 26. A clamp 29 presses an end of the sleeve 26 against the electrode with a clamping pressure adjusted by means of a wing nut 30. The sleeve can be composed of a suitably close knit fabric such as a polyacrylonitrile fabric or similar material which is relatively inert to the electrolyte and which is porous or otherwise permeable to or absorptive of electrolyte and capable of retaining the electrolyte in the interstices provided by the fabric. The fabric has a nap side in contact with the anode metal.

In using the process of the present invention, the applicator sleeve is mounted on a tin, cadmium, lead or indium anode depending upon which metal is to be plated. The workpiece is prepared for plating by cleaning, removing oxides, polishing, or the like. The sleeve covered anode is then immersed into the solution of electrolyte contained in the jar 23. The portion of the workpiece which is to be plated is then treated with the electrolyte laden sleeve, with rubbing but without any electroplating current being turned on. This preliminary treatment conditions the metal for subsequent reception of the plating. The plating current is then turned on, after the sleeve 26 has again been immersed in the electrolyte solution and the electroplating proceeds with a rubbing action of the applicator on the workpiece 15. After plating, the work can be rinsed with water and wiped dry. If a brighter plating is desired, the plated surface can be polished with a piece of fine steel wool.

The following is an example of a particularly preferred electrolyte composition:

Water: 16 fl. oz. (473 ml)
Granular sulfamic acid: 2 oz. (56.7g)
Wetting agent: 3–5 drops (0.18–30 ml)

To the above composition there can be added suitable color formers to provide identification of the solution.

The electrolyte solution of the present invention is considerably less corrosive than conventional electrolytes used for plating tin, cadmium, lead, or indium. The method of the present invention is particularly applicable in the art of portable electroplating for plating specific areas on small or large parts in the shop, in the field, or on production lines. The use of the improved system meets essential safety requirements for workers and the electrolyte is such that it can be shipped without restriction. No pollution control is required and expensive pressurized containers for corrosive electrolytes are not required.

It should be evident that various modifications can be made to the described embodiments without departing from the scope of the present invention.

I claim as may invention:

1. The method of plating a metal selected from the group consisting of tin, cadmium, lead, and indium onto a substrate which comprises providing an anode of said selected metal encased in a liquid absorbent sleeve, dipping said sleeve into an aqueous electrolyte containing dissolved free sulfamic acid in a concentration up to saturation and a non-ionic surface active agent to impregnate said sleeve with said electrolyte, said electrolyte being substantially devoid of ions of a plateable metal, rubbing the impregnated sleeve onto said substrate without electroplating voltage being applied, and thereafter applying an electroplating voltage to said anode to cause deposition of said metal onto said substrate.

2. The method of claim 1 in which said electrolyte contains from ¼ ounce sulfamic acid per 16 fluid ounces of electrolyte (7.09 g per 473 ml) up to saturation.

3. The method of claim 1 in which said electroplating voltage is in the range from about 2 to 10 volts.

4. The method of claim 1 in which said sleeve is composed of polyacrylonitrile.

* * * * *